US006716145B1

(12) United States Patent
Manailovich

(10) Patent No.: US 6,716,145 B1
(45) Date of Patent: Apr. 6, 2004

(54) PUSH-UP/CHEST EXERCISING DEVICE

(76) Inventor: John Manailovich, 51 Mudd Pond Rd., Blairstown, NJ (US) 07825

( * ) Notice: Subject to any disclaimer, the term of this patent is extended or adjusted under 35 U.S.C. 154(b) by 95 days.

(21) Appl. No.: 10/054,299

(22) Filed: Jan. 24, 2002

(51) Int. Cl.[7] ..... A63B 26/00; A63B 71/00
(52) U.S. Cl. ..... 482/141; 482/62; 482/148
(58) Field of Search ..... 482/908, 38, 141, 482/148, 62

(56) References Cited

U.S. PATENT DOCUMENTS 5,613,927 A * 3/1997 Rothacker ..... 482/123

* cited by examiner

*Primary Examiner*—Nicholas D. Lucchesi
*Assistant Examiner*—L. Amerson

(57) ABSTRACT

A push-up/chest exercising device for exercising one's chest muscles while performing push-ups. The push-up/chest exercising device includes a support assembly including a plurality of leg members and a support member being mounted upon the leg members; and also includes a plurality of handhold members being movably mounted upon the support member; and further includes a plurality of resistance members being mounted upon the support member and being connected to the handhold members to resist movement of the handhold members toward one another.

9 Claims, 2 Drawing Sheets

PUSH-UP/CHEST EXERCISING DEVICE

BACKGROUND OF THE INVENTION

1. Field of the Invention

The present invention relates to chest exercisers and more particularly pertains to a new push-up/chest exercising device for exercising one's chest muscles while performing push-ups.

2. Description of the Prior Art

The use of chest exercisers is known in the prior art. More specifically, chest exercisers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,226,868; U.S. Pat. No. 5,205,802; U.S. Pat. No. 4,900,015; U.S. Pat. No. 5,697,873; U.S. Pat. No. 6,110,082; and U.S. Pat. No. Des. 335,512.

While these devices fulfill their respective, particular objectives and requirements, the aforementioned patents do not disclose a new push-up/chest exercising device. The inventive device includes a support assembly including a plurality of leg members and a support member being mounted upon the leg members; and also includes a plurality of handhold members being movably mounted upon the support member; and further includes a plurality of resistance members being mounted upon the support member and being connected to the handhold members to resist movement of the handhold members toward one another and allows the user to not only perform push-ups but also work the pectoral or chest muscles at the same time, a feature not described nor suggested by any of the prior art.

In these respects, the push-up/chest exercising device according to the present invention substantially departs from the conventional concepts and designs of the prior art, and in so doing provides an apparatus primarily developed for the purpose of exercising one's chest muscles while performing push-ups.

SUMMARY OF THE INVENTION

In view of the foregoing disadvantages inherent in the known types of chest exercisers now present in the prior art, the present invention provides a new push-up/chest exercising device construction wherein the same can be utilized for exercising one's chest muscles while performing push-ups.

The general purpose of the present invention, which will be described subsequently in greater detail, is to provide a new push-up/chest exercising device which has many of the advantages of the chest exercisers mentioned heretofore and many novel features that result in a new push-up/chest exercising device which is not anticipated, rendered obvious, suggested, or even implied by any of the prior art chest exercisers, either alone or in any combination thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new push-up/chest exercising device which has many of the advantages of the chest exercisers mentioned heretofore and many novel features that result in a new push-up/chest exercising device which is not anticipated, rendered obvious, suggested, or even implied by any of the prior art chest exercisers, either alone or in any combination thereof.

Still yet another object of the present invention is to provide a new push-up/chest exercising device which provides in the apparatuses and methods of the prior art some of the advantages thereof, while simultaneously overcoming some of the disadvantages normally associated therewith.

Still another object of the present invention is to provide a new push-up/chest exercising device for exercising one's chest muscles while performing push-ups.

Still yet another object of the present invention is to provide a new push-up/chest exercising device that allows the user to move one's arms in and out while performing push-ups.

Even still another object of the present invention is to provide a new push-up/chest exercising device that provides the user with an easy and convenient two-in-one exercising device not found in other push-up/push-up/chest exercising devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
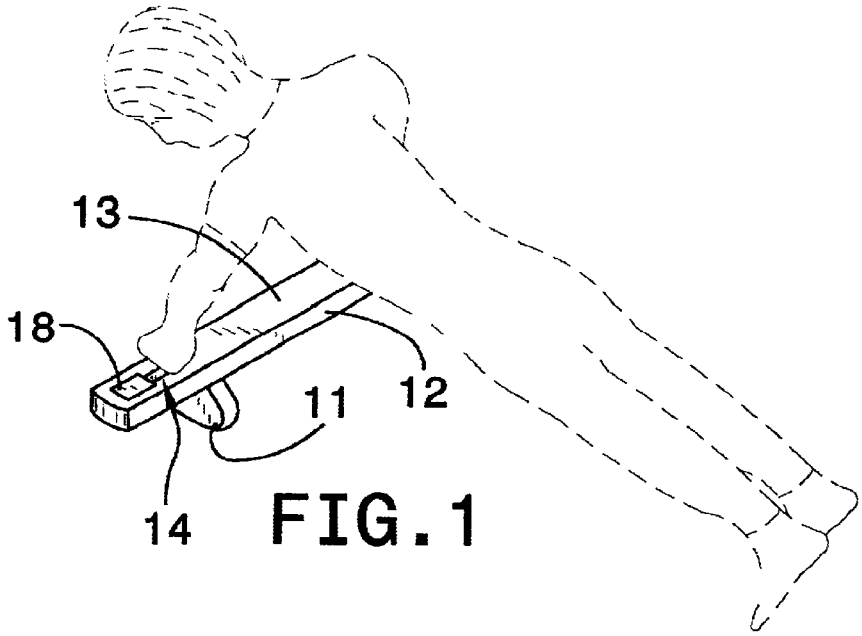
FIG. 1 is a perspective view of a new push-up/chest exercising device according to the present invention and shown in use.
Figure 2:
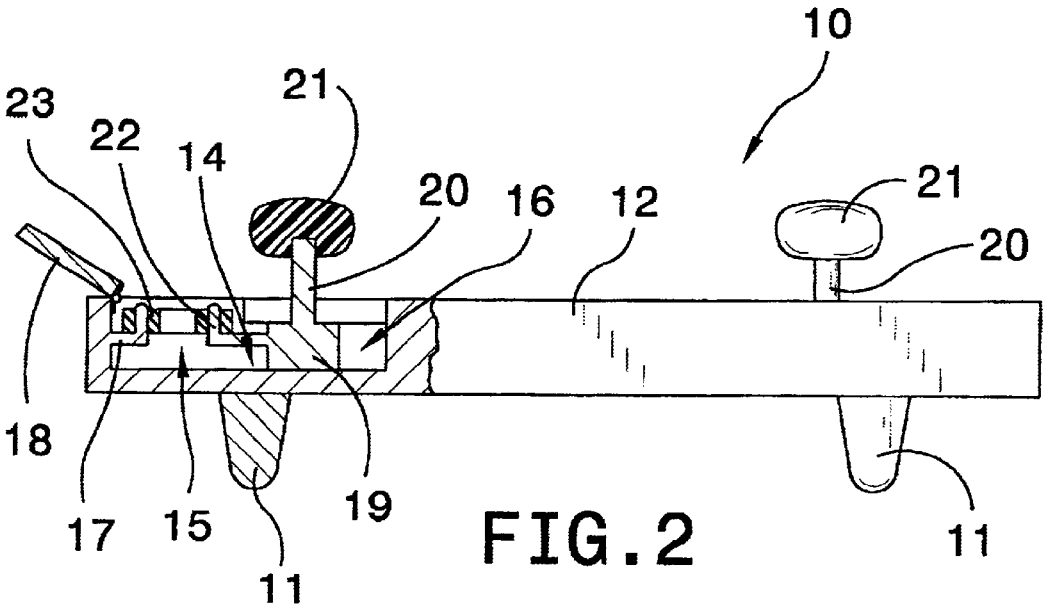
FIG. 2 is a partial cutaway rear elevational view of the present invention.
Figure 3:
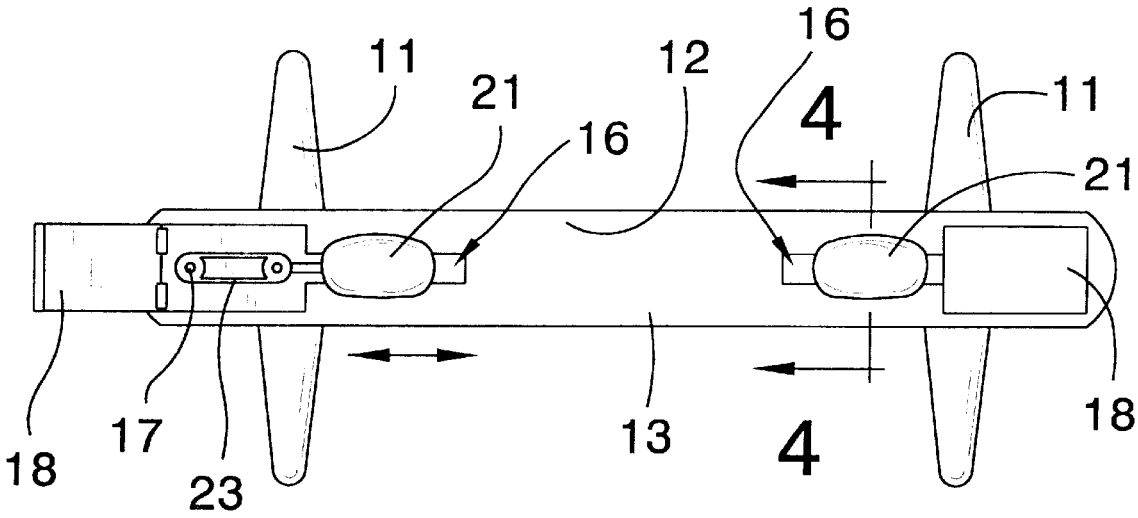
FIG. 3 is a top plan view of the present invention.
Figure 4:
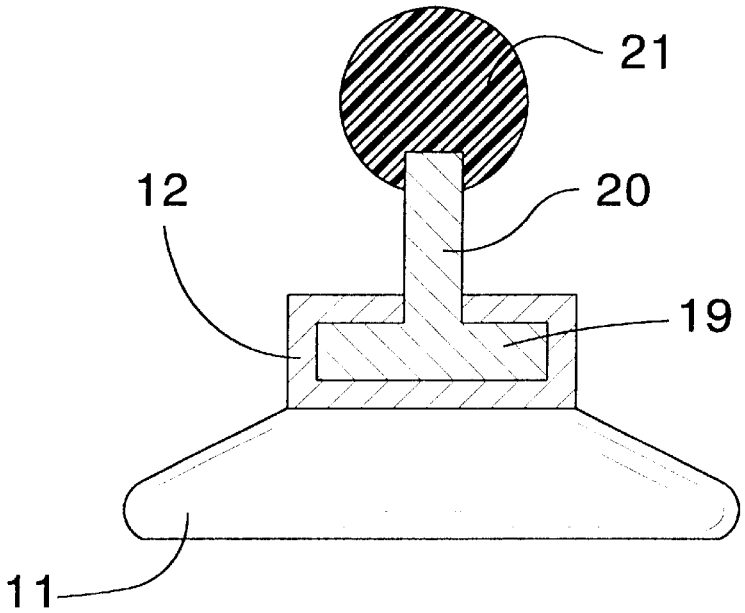
FIG. 4 is a cross-sectional view of the present invention.

With reference now to the drawings, and in particular to FIGS. 1 through 4 thereof, a new push-up/chest exercising device embodying the principles and concepts of the present invention and generally designated by the reference numeral 10 will be described.

As best illustrated in FIGS. 1 through 4, the push-up/chest exercising device 10 generally comprises a support assembly including a plurality of leg members 11 and a support member 12 being conventionally mounted upon the leg members 11. The support member 12 is elongated and has a top side 13 and a bottom side. The support member 12 further includes channels 14 being longitudinally disposed therein through the top side 13 thereof. Each of the channels 14 includes a main portion 15 and an inverted T-shaped portion 16 as viewed through a lateral cross-section of the support member 12. Each of the inverted T-shaped portions 16 extends longitudinally along a portion of the support member 12. The support assembly further includes first resistance supports 17 being conventionally and integrally attached to the support member 12 and being disposed in the main portions 15 of the channels 14. The support assembly also includes lids 18 being hingedly attached to the support member 12 and being removably closed over the main portions 15 of the channels 14.

A plurality of handhold members 19 are movably mounted upon the support member 12. Each of the handhold members 19 includes a base member 20 being slidably disposed in the inverted T-shaped portion 16 of a respective channel 14, and also includes a pad member 21 being conventionally attached to a top of the base member 20 and being adapted to be grasped by a user's hand. Each of the base members 20 is inverted T-shaped and has an enlarged body being disposed in a respective channel 14 and also has a stem being integrally attached to the enlarged body with a respective pad member 21 being conventionally mounted upon the stem. Each of the handhold members 19 also includes second resistance supports 22 being conventionally attached to the base members 19 of the handhold members 19 and being movably disposed in the main portions 15 of the channels 14. Each of the first and second resistance supports 17,22 is generally an angled prong member.

A plurality of resistance members 23 are conventionally mounted upon the support member 12 and are connected to the handhold members 19 to resist movement of the handhold members 19 toward one another. The resistance members 23 are elastic bands which are carried about the first and second resistance supports 17,22 to provide resistance against movement of the handhold members 19 toward one another.

In use, the user would position oneself upon the floor for performing conventionally push-ups and would place one's hands about the pad members 21, and as the user would begin to perform push-ups, the user would pull the handhold members 19 toward one another to exercise the pectoral or chest muscles.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A push-up/chest exercising device comprising:

a support assembly including a plurality of leg members and a support member being mounted upon said leg members, said support member being elongated and having a top side and a bottom side, said support member further including channels being longitudinally disposed therein through said top side thereof;

a plurality of handhold members being movably mounted upon said support member; and a plurality of resistance members being mounted upon said support member and being connected to said handhold members to resist movement of said handhold members toward one another.

2. A push-up/chest exercising device as described in claim 1, wherein each of said channels includes a main portion and an inverted T-shaped portion as viewed through a lateral cross-section of said support member, each of said inverted T-shaped portions extending longitudinally along a portion of said support member.

3. A push-up/chest exercising device as described in claim 1, wherein said support assembly further includes first resistance supports being attached to said support member and being disposed in said main portions of said channels.

4. A push-up/chest exercising device as described in claim 2, wherein said support assembly also includes lids being hingedly attached to said support member and being removably closed over said main portions of said channels.

5. A push-up/chest exercising device as described in claim 2, wherein each of said handhold members includes a base member being slidably disposed in said inverted T-shaped portion of a respective said channel, and also includes a pad member being attached to a top of said base member and being adapted to be grasped by a user's hand.

6. A push-up/chest exercising device as described in claim 4, wherein said each of said base members is inverted T-shaped and has an enlarged body being disposed in a respective said channel and also has a stem being attached to said enlarged body with a respective said pad member being mounted upon said stem.

7. A push-up/chest exercising device as described in claim 5, wherein each of said handhold members also includes second resistance supports being attached to said base members of said handhold members and being movably disposed in said main portions of said channels.

8. A push-up/chest exercising device as described in claim 6, wherein each of said first and second resistance supports is generally an angled prong member.

9. A push-up/chest exercising device as described in claim 7, wherein said resistance members are elastic bands which are carried about said first and second resistance supports to provide resistance against movement of said handhold members toward one another.

* * * * *